United States Patent [19]

Glasener

[11] Patent Number: 4,766,686

[45] **Date of Patent: * Aug. 30, 1988**

[54] SELF-RIGHTING DISPLAY DEVICE

[75] Inventor: Kenneth A. Glasener, Gold, Ill.

[73] Assignee: Dynagraphics Merchandising Corporation, Chicago, Ill.

[ * ] Notice: The portion of the term of this patent subsequent to Apr. 21, 2004 has been disclaimed.

[21] Appl. No.: 859,274

[22] Filed: May 1, 1986

Related U.S. Application Data

[63] Continuation of Ser. No. 628,458, Jul. 6, 1984, Pat. No. 4,658,526, which is a continuation-in-part of Ser. No. 510,633, Jul. 5, 1983.

[51] Int. Cl.[4] ..... G09F 7/00

[52] U.S. Cl. ..... 40/602; 40/606; 40/608

[58] Field of Search ..... 40/608, 602, 606, 609; 446/325, 396; 116/63 P; 248/DIG. 10

[56] References Cited

U.S. PATENT DOCUMENTS

| | | | |
|---|---|---|---|
| 524,894 | 8/1894 | Forsberg | 40/608 |
| 1,425,945 | 8/1922 | Congdon, Jr. | 446/396 |
| 1,465,642 | 8/1923 | Keene | 40/608 |
| 1,481,594 | 1/1924 | Fitzgerald | 40/608 |
| 1,620,598 | 3/1927 | Foster | 272/76 |
| 1,952,250 | 3/1934 | Hallowell et al. | 40/606 |
| 2,411,372 | 11/1946 | Hicks | 40/152.1 |
| 2,554,923 | 5/1951 | Reitz | 40/333 |
| 2,937,892 | 5/1960 | Gilman | 446/396 |
| 3,335,433 | 8/1967 | Stopek | 446/396 |
| 3,341,958 | 9/1967 | Pardue | 40/613 |
| 3,699,913 | 10/1972 | Sautbine | 40/608 |
| 3,868,630 | 2/1975 | Lesondak | 40/606 |
| 4,394,843 | 7/1983 | Ediriwira | 40/608 |

FOREIGN PATENT DOCUMENTS

| | | | |
|---|---|---|---|
| 19481 | of 1929 | Australia | 40/602 |

*Primary Examiner*—Robert P. Swiatek
*Assistant Examiner*—Cary E. Stone
*Attorney, Agent, or Firm*—McDermott, Will & Emery

[57] ABSTRACT

A poster display, subject to out-of-door wind forces that will develop substantial overturning forces against the poster display, is provided with a self-righting feature by using a hollow support base, with a convex support side that permits of rocking motion and that is ballasted by a flowable ballast material such as water, and upon which base, an upright, wind-catching, panel is mounted to project away from the convex support side. The base and panel are molded of inexpensive plastics. The base and panel may be formed as separate parts, or as an integral assemblage. In one preferred construction the base and panel are separate parts, have interfitting tongue and socket provided on adjacent portions of the two parts. The panel is preferably provided with a transverse edge flange that bound the region adapted to receive a removable display sheet thereonto. In alternate forms of construction, the concept of a convex support side that permits of rocking motion of the poster display is preserved, but the ballasting of the poster display is secured through a plate of heavy density material located either within the hollow support base, or on the exterior of the convex support side of the base of the rocking display, and with the center of gravity of the ballasting located substantially in the medial vertical plane through the poster display device. In another alternate form of construction, the display does not rock, but the poster display is free to swing relative to the support structure.

4 Claims, 3 Drawing Sheets

FIG. 1
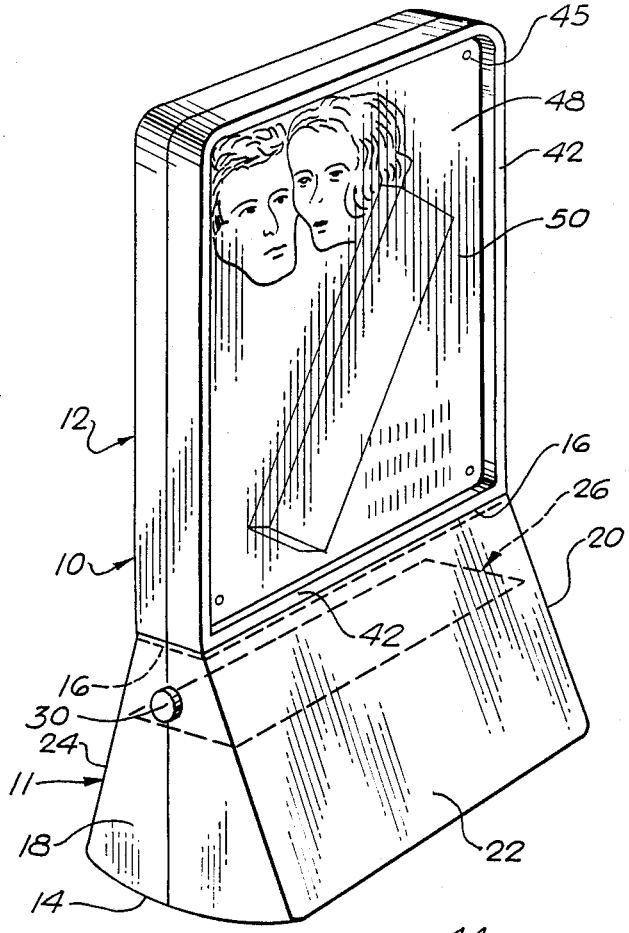
FIG. 3
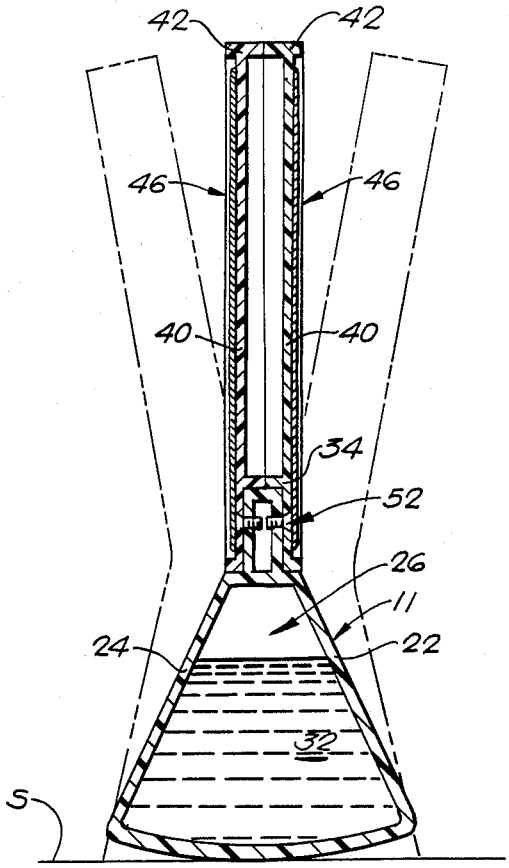
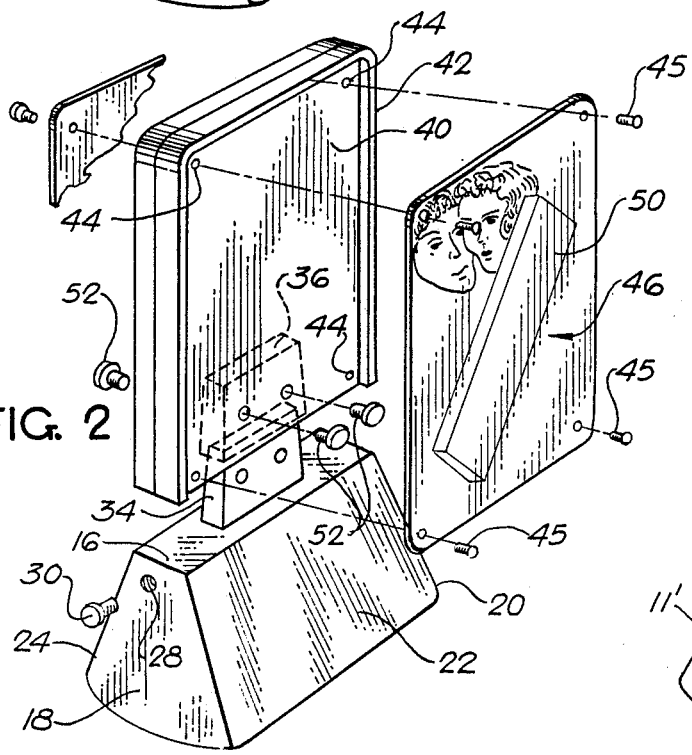
FIG. 2
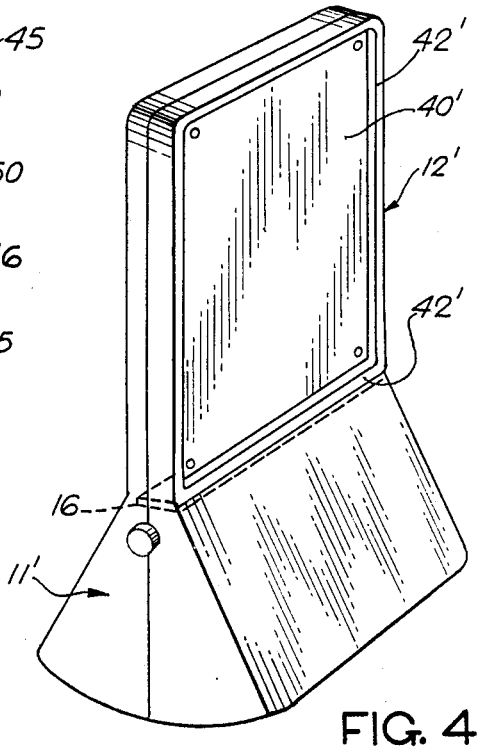
FIG. 4

SELF-RIGHTING DISPLAY DEVICE

This is a continuation of application Ser. No. 628,458, filed July 6, 1984, now U.S. Pat. No. 4,658,526, which is a continuation-in-part of my copending application, Ser. No. 510,633, filed July 5, 1983.

FIELD OF THE INVENTION

This invention relates to a poster display device and more particularly to a rocking, or self-righting, display device adapted to be moved by the wind, so as to be particularly useful for out of doors advertising.

BACKGROUND OF THE INVENTION

Poster display devices for advertising, and which are adapted to be moved by the wind blowing out of doors, are well known. These display devices are generically referred to as a driveway sign, and are frequently positioned in front of roadside located business establishments, such as gasoline stations.

Where large posters and frames therefor are used, mounted on a stationary stand, and if the wind forces developed against the display are large enough, the stand for such outdoor advertising displays may be overturned, improvidently providing discontinuance of exhibition of the display and possible injury to a bystander.

It has been proposed, in prior devices, to articulate such display devices, by spring mounting the poster frame on a stationary base support for the advertising sign, such as in U.S. Pat. Nos. 3,646,696; 3,662,482; and 4,033,536. Problems that arise in connection with spring mountings for wind-movable advertising poster frames or displays, are discussed in U.S. Pat. No. 4,033,536 which proceeds to disclose a special, and more expensive, mounting bracket and coil spring for avoiding the problems reported.

As reported in U.S. Pat. No. 3,646,696, wind-movable displays have also used an upright hanger frame from which a poster frame has been top-suspended, in a manner similar to a pendulum, so that the frame swings independently of the support, but said patent further reports that, in practice, such devices will topple under the force of a strong wind.

One factor associated with all such prior art wind-movable displays is that the advertising poster-carrying frame is movable separately from the support base, or frame, and this means that movement of the advertising poster relative to the base could be dangerous, if there is a strong wind and if a person is standing adjacent to, and in the path of the movable sign, when the sign is moved by a strong wind.

Other problems associated with the prior art devices lies in the fact that such devices have usually employed metal parts, which means that the metal is subject to the corrosive effects of weathering, and the use of metal makes such devices relatively expensive.

SUMMARY OF THE INVENTION

One object of this invention is to provide a relatively inexpensive self-righting poster display device that is not subject to the problems that attend the use of prior devices.

Another object of this invention is to provide a self-righting, out-of-doors, poster display device: whose parts are of light weight, and may be molded or relatively inexpensive plastic materials; whose base and poster frame are connected together, so that both the frame and base move together under force of wind, but with the base constructed and arranged to operate to restore both the poster frame and the base to their normal upright position when the wind dies down; whose base may be integral with or seperable from the display poster; whose frame is of such construction as to permit the advertising display thereon to be easily changed, as desired; the base being of hollow construction to limit the shipping weight of a unit, with said hollow base being adapted to be weighted by an inexpensive and readily available flowable ballast, such as water.

While the foregoing objects of this invention are obtained by a first preferred form of construction as herein disclosed, some objects of the invention are obtainable with use of ordinary ballast, in the form of heavy plates or the like, particularly adapted to cooperate with a moulded frame and base construction.

Further objects and advantages will become known to one skilled in the art, as these specifications proceed to describe the invention and the improved constructions disclosed herein.

BRIEF DESCRIPTION OF THE DRAWINGS

FIG. 1 is a perspective view of one form of a poster display device constructed to embody features of this invention;

FIG. 2 is a perspective view, partially exploded to disclose details, of a second form of the poster display device of this invention;

FIG. 3 is a vertical cross-sectional view, taken through the assembled form of the invention shown in FIG. 2;

FIG. 4 is a perspective view of another form of a poster display, wherein the poster frame is formed integral with the base;

DETAILED DESCRIPTION OF THE INVENTION

Figure 5:
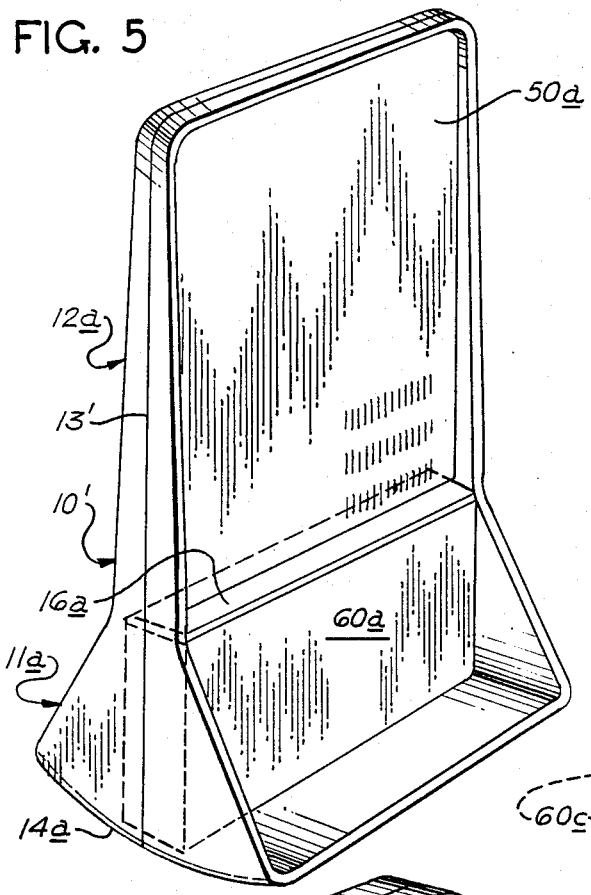
FIG. 5 is a perspective view, similar to FIG. 1, but showing modifications for the forming or assembly of the device, and for weighting the base of the poster display device by use of a vertically arranged weight member below the sign portion of the display device.

Referring now to the drawings, FIG. 1 discloses one form of my invention. The display device, generally 10, includes a base portion 11, and a superposed, sign portion 12. The base portion 11 and sign portion 12 may be formed as separable parts, as in FIGS. 2–3, or as a unitary device as in FIG. 4.

The base portion 11 is laterally elongated and includes a convex, lowermost, rocking surface, or side, 14 adapted to rest on a flat support surface S, and being spaced below a generally flat upper side 16, with continuous side wall means interconnecting sides 14 and 16. More specifically, a pair of opposed, upright, end walls 18 and 20, and a pair of inclined upright side walls 22 and 24, extend between rocking side 14 and top side 16, with all sides cooperating to surround and enclose a hollow chamber 26 within base 11.

The end wall 18 of the base portion 11 is of partially frustro-conical shape, with the lower, convex, rocking edge of said shape being provided by the exterior curved side 14. The interior chamber 26 of the hollow base 11 has a shape that is congruent with the exterior shape of the base, but differs in size by the wall thicknesses of the base's bounding sides.

The base 11 is formed of plastic to provide a lightweight body. The end wall, 18, has an aperture 28 provided therethrough, that may be selectively opened, or closed by a stopper, or cap 30, and through which aperture 28 a flowable ballast may be introduced into the hollow interior 26 of the base, thereby providing a substantial weight within the base portion 11 that serves to make the display a self-righting one, relative to the lateral wind force that can be developed against the upright sign portion 12 thereabove. In the preferred form, the flowable ballast is water, as indicated at 32, or may be some other liquid, or may even be in the form of a granular material such as sand. If water is used, the water may include anti-freeze, to prevent freezing when the display device is being used in freezing weather.

The sign portion 12 could be made integral with base portion 11, as in FIG. 4, or separable from base portion 11, as in FIGS. 1–3. If the portions are separable, the display device is provided with means for easily effecting assembly in the field. Toward this end, and as shown in FIGS. 2 and 3, the upper wall, or flat side, 14 is provided on the exterior thereof with an upstanding tongue 34, adapted for telescoping cooperation with a generally congruent socket 36 provided on or in the lower edge of sign portion 12. The tongue 34 is laterally elongated, relative to the length of wall 16 of the laterally elongated base 11, as seen in FIG. 2, to provide for an appropriate, and structurally sound, interconnection between base 11 and upper sign portion 12.

The sign portion 12 includes at least one rigid display support panel 40, that is surrounded on at least three edges thereof by a transverse flange 42. In the form illustrated in FIG. 1, the display support panel 40 has the transverse flange 42 extended along the bottom edge, and adapted to abut upper wall 16 of the base portion 11. The display panel(s) 40 preferably should be of plastic and be molded integral with the surrounding transverse flange 42, which flange serves as edge flange means that bound the region on the panel that is adapted to receive a removable display sheet, or cardboard thereonto.

Apertures 44, provided through display surface 40 provides means for receiving therethrough fasteners 45 for attaching an advertising display panel 46 to the support panel 40. The display panel 46 could be a printed sheet, or a display formed from any material, such as cardboard, and may exhibit the advertising in planar form, or three-dimensional form, such as suggested in FIG. 1, wherein the advertising display is shown as panel 48 onto which an interchangeable 3-dimensional display 50 may be assembled.

The non-circular socket 36 provided on the sign portion 12 may be provided by using two spaced support panels 40, or may be provided by a non-circular pocket construction secured to the lower end of a single support panel 40, and any attachment means, such as through bolts, or threaded socket and screws, 52 may be used to secure sign portion 12 to tongue 34. Preferably, the lower edge of sign portion 12 abuts the uppermost side of wall 16 of the base, to effect a stable connection between sign portion 12 and base 11.

In an alternate form of construction, as indicated in FIG. 4, the sign portion 12' is formed integral with the upper, flat side, 16 of the base portion 10.

In the form of construction shown in FIG. 4, the base portion 11' is formed as disclosed in connection with FIGS. 1–3, but the sign portion 12' is then secured or attached to the top wall 16' in a manner so as to be integral therewith, thereby eliminating the need for a tongue and socket connection. The sign portion 12' still will have at least one display panel 40', surrounded by a transverse flange 42' and adapted to provide a sleeve for receivng thereinto a display panel 46.

When not in use, and/or for purposes of storage or shipping, the fill aperture 28 may be unstoppered, or uncapped, and by tipping the hollow base 11, the ballast may be drained from the hollow base 11.

The hollow base 11 will normally be shipped in that condition, and since base 11 is made of plastic, it is relatively light weight. At the site of usage, the aperture 28 is unstoppered, and a hose nozzle can be inserted in aperture 28 to effect filling the hollow chamber 26 to a desired amount. A marking (not shown) could be provided on any of the upright walls to indicate the level to which chamber 26 is to be partially filled with water, if that is desired.

It will be understood that when an assembled sign is in the condition shown in FIG. 3, the force of wind against the upright sign portion 12 will tend to move the sign to a position as shown in broken lines in FIG. 3, but the weight of ballast 32 coupled with the convex bottom wall 14, will tend to restore the assembly to its full line position shown in FIG. 3.

As the assembled sign moves to the broken line position of FIG. 3, the horizontal component of a constant wind force tending to effect overturning will be reduced, and this permits the center of gravity of the ballast to provide an increasing restoring torque about the portion, or edge, of the wall 14 that engages the generally flat support surfaces.

As an example of size of device contemplated, the total height of the construction in FIG. 1 would be about 72 inches, and the length of the elongated base would be approximately 40 inches.

As additional, and modified, forms of a poster display device, there are provided constructions as seen in FIGS. 5–8.

In FIG. 5, a molded display device 10' has an exterior shape similar to that shown in FIG. 1 except that the base portion **11*a*** does not enclose a chamber into which flowable ballast may be selectively entered and confined.

Instead, the display device 10' has an open-sided base portion **11*a* and a sign portion 12*a* extending thereabove. The base portion 11*a* and sign portion 12*a* may be integrally molded to the shape shown, or may be made in two vertically elongated mirror-image segments that are joined together along a continuous peripheral seam 13'. The lower surface of the display device has a convex, rocking surface whose curved rocking side is designated by trace 14a. A transverse shelf 16a may be provided extending transversely between the lateral upright sides of the display device 10', and serving to divide the region bounded by the walls of the display device 10' into an upper section 12a adapted for holding one or a pair of oppositely facing display panels 50a, and a lower section 11a**.

One structural variation shown in FIG. 5, as compared with the structures shown in FIGS. 1–4, is the fact that the base portion 11a, while having a curved lower rocking surface 14a, is open at its front and rear sides, and a plate 60a of heavy metal, such as iron, or other heavy density material, is inserted at a vertical altitude, between the underside of shelf 16a and the upper surface of the arcuate rocking side that is opposite side 14a. Any appropriate means, including the resilience of the material of shelf 16a and of the bottom wall of base portion 11a, or retaining clips (not shown) may be relied upon for holding weighting plate 60a in position. By reason of the symmetrical arrangement as shown and described, the center of gravity of the heavy density plate 60a is located in the medial vertical plane of the display device which corresponds substantially with a vertical plane that would lie approximately in the plane of seam 13'.

Figure 6:
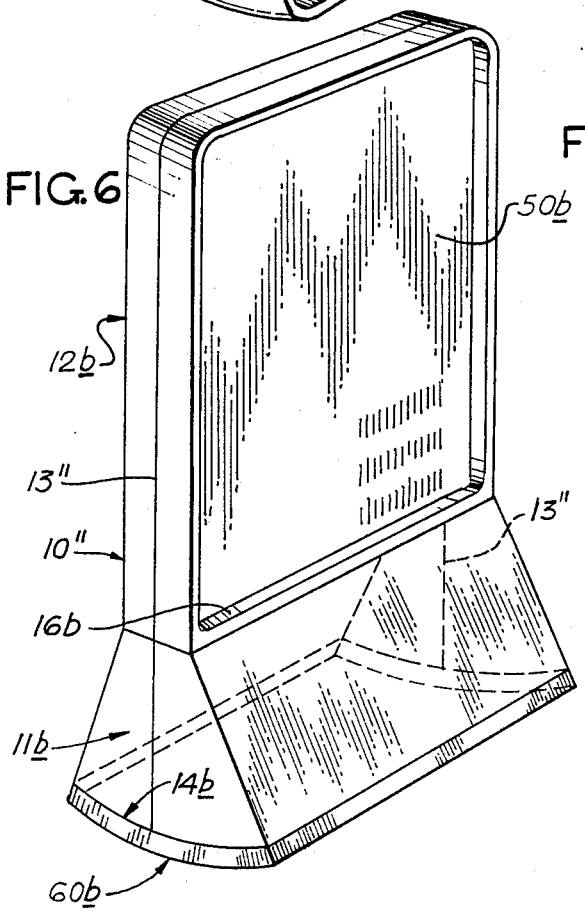
FIG. 6 is a perspective view, similar to FIG. 1, but showing a further modification of the weighting of the base of the poster display device, by providing a weight on the exterior of the rocking base.

In an additional, and further modified, form shown in FIG. 6, a display device 10'' is exteriorly shaped similarly to that forms of construction shown in FIGS. 1–5, providing a base portion 11b similar to base 11 seen in FIG. 1, and an upright sign portion 12b thereabove that includes a transverse shelf 16b, above which are located display panels 50b, one of which is seen in FIG. 6. A structural variation in this modified form is the provision of an arcuate plate 60b of metal, or other heavy density material, being secured by any appropriate means, such as adhesives or by physical structures such as bolts or screws (not shown) to the underside of the curved lower side 14b of the base portion 11b, to provide a convex surface about which the display device rocks while simultaneously providing the mass which tends to restore the tilted display device to the upright attitude shown. The display device 10'', with the exception of plate 60b, again is preferably formed of two minor-image segments, molded of plastic, and joined together along a continuous peripheral seam 13''. Because of the symmetry of the construction shown, the center of gravity of the plate 60b is located in the medial vertical plane of the display device, which corresponds substantially with the vertical plane through attachment seam 13''.

Figure 7:
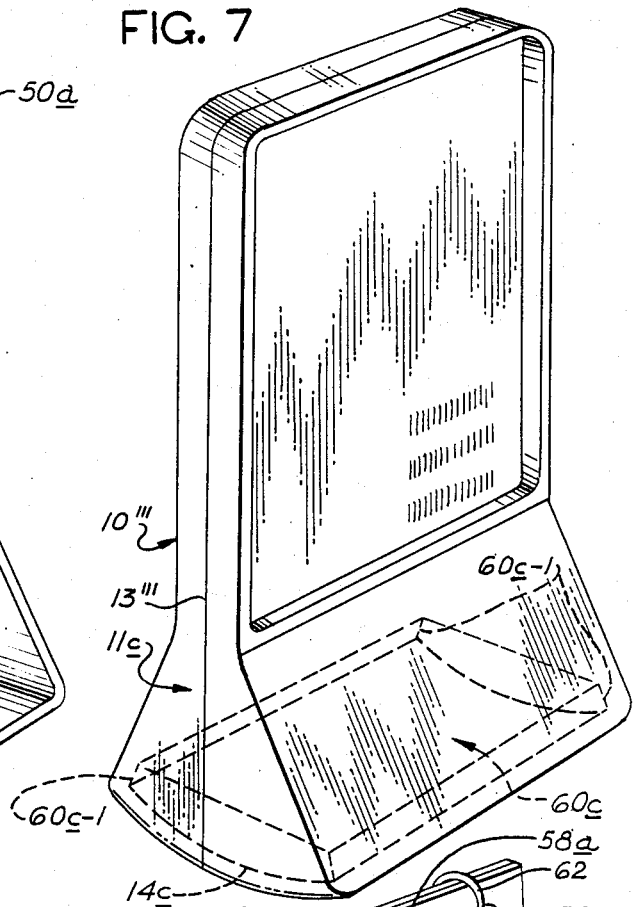
FIG. 7 is a perspective view, similar to FIG. 6, but showing a modification of the weighting of the base of the poster display device, by providing a plate type weight within the interior of the rocking base.

In the additional, and further modified form of FIG. 7, the display device 10''' is very similar to the one shown in FIG. 6 with the exception that a righting mass in the form of a weighting plate 60c is located within the hollow base portion 11c, and is shaped to lie against the concave inner side of the convex rocking surface 14c. Again the display device 10''' is preferably formed of two molded mirror image sections that are joined together along a continuous peripheral seam 13''', and the weighting mass, or plate 60c, may have a portion thereof first inserted into one molded section of the molded display device, before the second molded section is assembled and then joined to the first section along continuous, vertical, peripheral seam 13'''. By reason of the slope of the side walls of the base portion 11c, and the corresponding beveled, or sloped, edges of weighting plate 60c, as indicated by traces 60c-1, the weighting plate 60c cooperates with said side walls of the base portion to be held symmetrically in the position shown.

Figure 8:
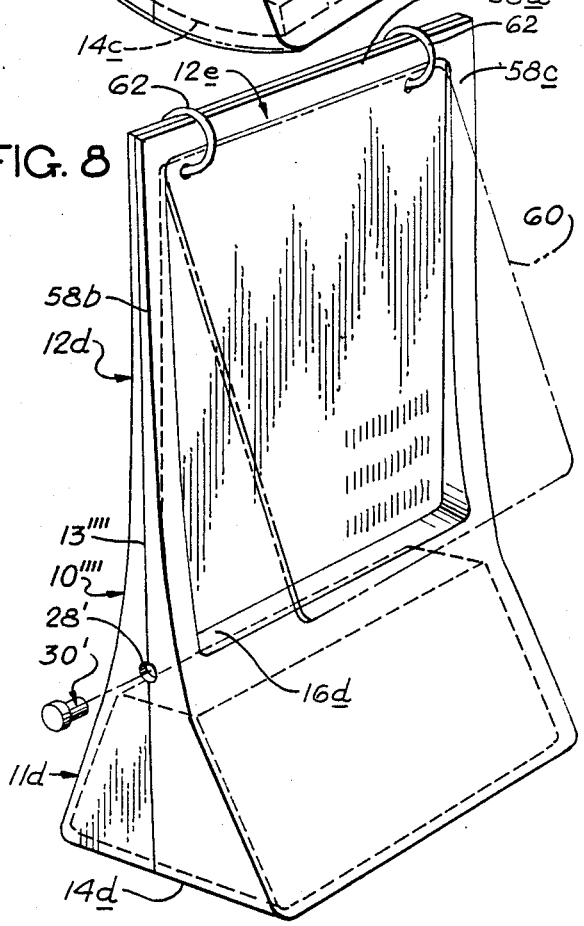
FIG. 8 is a perspective view, similar to FIGS. 1 and 3, showing the weighting of the base of the poster display device in the manner shown in FIG. 3, but with the poster display mounted for swinging from the top cross-member of an inverted U-shaped bar-like frame that extends upwardly above the base of the poster display device.

In still another form of display device shown in FIG. 8, the device is not intended to rock, and the lowermost surface thereof 14d is made planar, or flat. The display device 10'''' of FIG. 8 is formed of two molded mirror image sections that are joined together along a continuous, peripheral, vertical seam 13''''. In this form of construction, the base portion 11d is hollow and is adapted to be filled, through an aperture 28' that is adapted to be stoppered by a plug stopper 30', with a flowable ballast such as water, or water and anti-freeze mixture, or sand, or gravel. Extending upwardly of base portion 11d is an upwardly projecting, inverted U-shaped, sign support 12d whose bight 12e provides an uppermost transverse bar 58a from which a poster-carrying panel 60 is suspended, to be free to swing under pressure of wind. The swingable panel 60 is suspended through a pair of rings 62 that encircle the bight 58a of tansverse support bar; and which confines the panel 60 to movement along a path between the legs 58b and 58c of the U-shaped support, and the height of panel 60 is selected to be smaller than the spacing between bight 58a and the upper side 16d of the base portion 11d.

Figure 9:
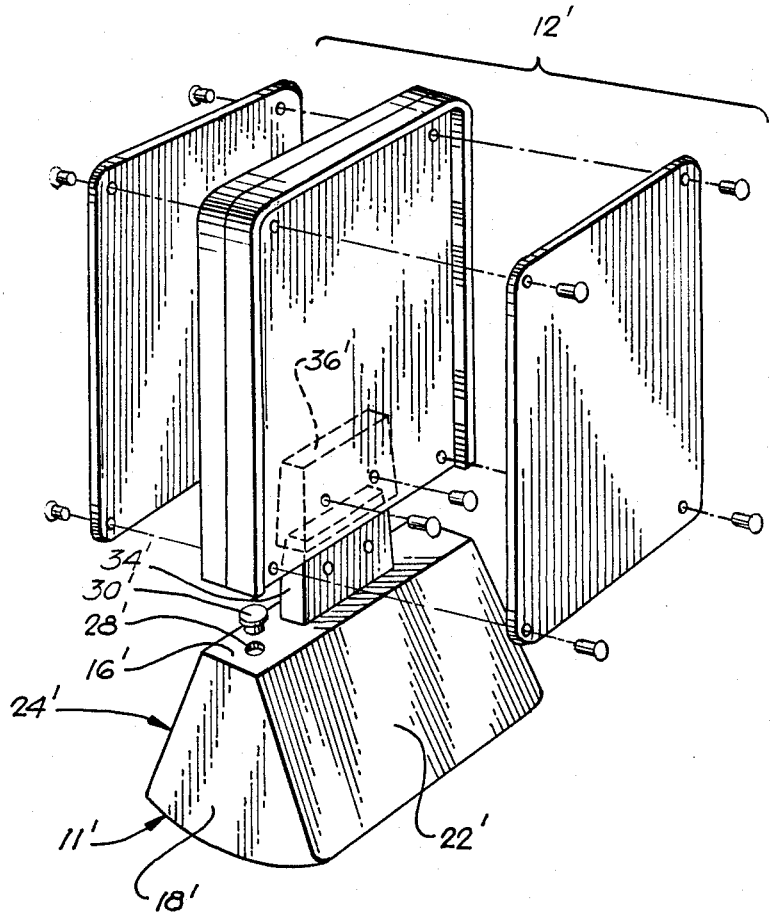
FIG. 9 is a perspective view, similar to FIGS. 1 and 2 showing a modified construction of those forms of devices.

In FIG. 9, the form of display device there shown is similar in many respects to the forms shown in FIGS. 1 and 2 with the following principal departures or variations. Rather than have the end wall 18' apertured at 28, as seen in FIGS. 1 and 2, the flat upper side 16' is provided with a fill aperture 28' therein. With this construction, when the sign portion 12' is mounted on the base 11', the fill aperture 28' and its closure 30' may be concealed by the sign thereabove, leaving more attractive side walls on the base.

Each of the side walls 18', 22' and 24' of base 11 may have additional signs imprinted thereon, or adhesively affixed thereto.

Also, instead of having base portion 11' provided with an upstanding tongue 34, as seen in FIG. 2, that enters into a downwardly opening lower recess, or socket 36 in sign portion 12 of FIG. 2, the sign portion 12' of FIG. 9 may be provided with downwardly extending, one or more tongues 34', which enter into upwardly opening, recesses 36' provided in the upper wall 16' of base 11' as seen in FIG. 9.

While there has been disclosed several particular embodiments of my invention, the inventions intended to be covered by this application will be understood, by one skilled in the art, as limited solely by the claims appended hereto.

What is claimed and desired to be secured by Letters Patent of the United States is:

1. In a self-righting, rockable, display device that is adapted to be positioned out-of-doors and to be moved by wind blowing thereagainst, and having an axially elongated arcuate lowermost convex rocking wall portion, about which rocking of the display device, in response to wind, takes place, and wherein the display device includes a pair of identical, vertically elongated, segments, that are joined together in mirror image relationship along a continuous, peripheral, elongated seam that extends along the entire vertical height and width of the rockable display device;

the improvement comprising, in combination: a transverse shelf mounted above said convex rocking wall portion and serving to divide the display device into an upper section above which an advertising display is to be positioned, and a lower section, said transverse shelf being smaller in cross sectional area than the lower section and at least as large in cross sectional area as the upper section;

said upper section being further shaped to provide a pair of laterally spaced sides connected to and extending above the transverse shelf to bound a sign holding section that is adapted to hold a pair of oppositely facing display panels positioned above the transverse shelf and between the pair of upright sides that extend above the transverse shelf;

said lower section including a pair of laterally spaced, lower upright side walls which are coplanar with said pair of lateral upright sides that extend above the transverse shelf, said laterally spaced, lower upright side walls extending below said transverse shelf and being joined to the axial ends of said axially elongated convex rocking wall portion;

said pair of vertically elongated segments being molded of plastic to provide a lightweight construction; and weighting means carried by said lower section to provide stability for the lightweight construction, and to cause said self-righting display to be normally positioned in an upright attitude.

2. A construction as in claim 1, wherein there is an open space provided between the convex rocking wall portion and the transverse shelf, and said weighting means includes a heavy density, plate-like, member positioned in an upright plane between the convex rocking wall portion and the underside of the transverse shelf.

3. A construction as in claim 1, wherein said weighting means includes an arcuate plate of metal secured to the exterior of the convex rocking wall portion.

4. A construction as in claim 1 wherein said lower section defines a walled cavity, located above the convex rocking wall portion and below said transverse shelf, and weighting means including a heavy plate-like member located in said walled cavity and whose lowermost surface is of a length and curvature to engage the arcuate length of the concave inner side of the convex rocking wall portion.

* * * * *